US011560812B2

(12) United States Patent
Preibisch

(10) Patent No.: US 11,560,812 B2
(45) Date of Patent: Jan. 24, 2023

(54) STEAM TURBINE AND METHOD FOR OPERATING SAME

(71) Applicant: Siemens Energy Global GmbH & Co. KG, Bayern (DE)

(72) Inventor: Stefan Preibisch, Gorlitz (DE)

(73) Assignee: Siemens Energy Global GmbH & Co. KG, Bayern (DE)

( * ) Notice: Subject to any disclaimer, the term of this patent is extended or adjusted under 35 U.S.C. 154(b) by 0 days.

(21) Appl. No.: 17/289,463

(22) PCT Filed: Oct. 15, 2019

(86) PCT No.: PCT/EP2019/077895
§ 371 (c)(1),
(2) Date: Apr. 28, 2021

(87) PCT Pub. No.: WO2020/099054
PCT Pub. Date: May 22, 2020

(65) Prior Publication Data

US 2021/0396154 A1 Dec. 23, 2021

(30) Foreign Application Priority Data

Nov. 13, 2018 (DE) ..... 10 2018 219 374.6

(51) Int. Cl.
*F01D 25/26* (2006.01)
*F01D 11/00* (2006.01)

(52) U.S. Cl.
CPC ..... *F01D 25/26* (2013.01); *F01D 11/005* (2013.01); *F05D 2220/31* (2013.01)

(58) Field of Classification Search
CPC ..... F01D 25/26; F01D 11/005; F05D 2220/31
See application file for complete search history.

(56) References Cited

U.S. PATENT DOCUMENTS 3,773,431 A 11/1973 Bellati et al.
5,149,247 A 9/1992 Gros et al.
(Continued)

FOREIGN PATENT DOCUMENTS

CN 104204422 A 12/2014
CN 104533550 A 4/2015
(Continued)

OTHER PUBLICATIONS

English Translation DE-69000984-T2 (Year: 1993).*
(Continued)

*Primary Examiner* — Shafiq Mian
(74) *Attorney, Agent, or Firm* — Wolter Van Dyke Davis, PLLC

(57) ABSTRACT

A steam turbine having a low-pressure inner housing NDIG and a high-pressure inner housing HDIG within a steam turbine outer housing, a reheater downstream of the HDIG and upstream of the NDIG wherein the first steam inlet section of the HDIG faces the second steam inlet section of the NDIG, a process steam deflection section for deflecting process steam out of the first steam outlet section into a gap between an inner wall of the steam turbine outer housing and an outer wall of the HDIG and of the NDIG, a high-pressure sealing shell for sealing the upstream end-section of the HDIG, a low-pressure sealing shell for sealing the upstream end-section of the NDIG, the high-pressure sealing shell located adjacent to the low-pressure sealing shell, wherein process steam can be drawn from the HDIG and conveyed to a region between the high- and low-pressure sealing shells.

10 Claims, 2 Drawing Sheets

(56) References Cited

U.S. PATENT DOCUMENTS

| | | | | |
|---|---|---|---|---|
| 10,227,873 | B2 | 3/2019 | Assmann | |
| 2014/0150431 | A1* | 6/2014 | Glos | F01D 25/14 60/670 |
| 2015/0047354 | A1 | 2/2015 | Potter | |
| 2016/0312636 | A1* | 10/2016 | Imai | F16J 15/3448 |
| 2018/0080324 | A1* | 3/2018 | Lymn | F01D 1/30 |
| 2018/0298787 | A1* | 10/2018 | Becker | F01K 3/188 |
| 2020/0096384 | A1* | 3/2020 | Saburi | F01D 21/003 |
| 2020/0156283 | A1* | 5/2020 | Kopping | C04B 35/63424 |
| 2020/0318497 | A1* | 10/2020 | Haas | F01K 23/10 |

FOREIGN PATENT DOCUMENTS

| | | | | |
|---|---|---|---|---|
| CN | 105612314 | A | 5/2016 | |
| CN | 107923246 | A | 4/2018 | |
| DE | 1872434 | U | 5/1963 | |
| DE | 69000984 | T2 * | 6/1993 | F01D 25/26 |
| DE | 69000984 | T2 | 6/1993 | |
| DE | 102010033327 | A1 | 2/2012 | |
| EP | 0394894 | B1 | 3/1993 | |
| EP | 1744017 | A1 * | 1/2007 | F01D 25/26 |
| EP | 1744017 | A1 | 1/2007 | |
| JP | H1089013 | A | 4/1998 | |
| WO | 2012016809 | A1 | 2/2012 | |

OTHER PUBLICATIONS

English Translation EP-1744017-A1 (Year: 2007).*

PCT International Search Report and Written Opinion of International Searching Authority dated Feb. 5, 2020 corresponding to PCT International Application No. PCT/EP2019/077895 filed Oct. 15, 2019.

* cited by examiner

STEAM TURBINE AND METHOD FOR OPERATING SAME

CROSS REFERENCE TO RELATED APPLICATIONS

This application is the US National Stage of International Application No. PCT/EP2019/077895 filed 15 Oct. 2019, and claims the benefit thereof. The International Application claims the benefit of German Application No. DE 10 2018 219 374.6 filed 13 Nov. 2018. All of the applications are incorporated by reference herein in their entirety.

FIELD OF INVENTION

The present invention relates to a steam turbine and to a method for operating a steam turbine.

BACKGROUND OF INVENTION

In steam power plants, water vapor is used as working medium for the operation of steam turbines. The water vapor is warmed in a steam boiler and flows as process steam via pipelines into the steam turbine. In the steam turbine, the thermal energy previously contained in the working medium is converted into kinetic energy. The kinetic energy is commonly used to operate a generator which converts the generated mechanical power into electrical power. Alternatively, the kinetic energy may also be utilized for driving machines, for example pumps. The expanded and cooled process steam flows into a condenser, where it condenses as a result of heat transfer in a heat exchanger, and is fed as water back to the steam boiler in order to be heated.

Conventional steam turbines have at least one high-pressure part and at least one low-pressure part, which are also referred to as high-pressure stage and low-pressure stage respectively. In the low-pressure part, the temperature of the process steam falls significantly, which can result in partial condensation of the process steam. Here, the low-pressure part is highly sensitive with regard to the moisture content of the process steam. If the process steam reaches the low-pressure part of the steam turbine with a moisture content of approximately 8 to 10%, measures must be implemented which reduce the moisture content of the process steam upstream of the inlet into the low-pressure part to an admissible level.

In order to increase the efficiency of a steam power plant, the process steam is, before it enters the low-pressure part, fed for so-called intermediate superheating. In the intermediate superheating process, the process steam is heated again such that the moisture content falls. During this intermediate superheating, the entire steam mass flow is extracted from the steam turbine downstream of the high-pressure part, fed for intermediate superheating, and heated approximately to the temperature of the fresh steam. The process steam is subsequently fed to the low-pressure part. Without such intermediate superheating, it would be necessary for the steam turbine to be stopped, because condensed water droplets could strike the rotating turbine blades and would cause damage as a result of droplet erosion on the turbine blades.

In the case of multi-stage steam turbines, at least one medium-pressure stage is used in addition to a high-pressure stage and a low-pressure stage. Here, such intermediate superheating of the process steam is performed in each case between the individual turbine stages. This leads to increased efficiency, because mechanical energy can be generated in the turbine stages more efficiently by means of the superheated water vapor.

In the implementation of intermediate superheating systems in steam turbines, the material and the outer wall, in particular between the individual turbine stages, are subject to high loading. At the first turbine stage, the relatively cold water vapor is extracted and fed to the intermediate superheater, and the heated process steam is fed to the second turbine stage. Here, high temperature differences arise in the outer wall in the transition region between the first turbine stage and the second turbine stage. Since the end of the first turbine stage, from which the cold process steam is extracted, and the beginning of the second turbine stage, in which the hot process steam is fed from the intermediate superheater, lie close together, high thermal stresses arise there in the outer wall. This can lead to leaks or to cracks in the outer wall. Furthermore, there is the risk that wet steam parameters prevail during the extraction of the cold process steam from the first turbine stage, and condensate thus forms on the inner wall of the outer housing. The condensate additionally cools the inner side of the outer wall. The thermal stress at the outer wall is thus increased. In order that the superheated process steam does not cause damaging thermal stresses, the superheated process steam is cooled in order to reduce the thermal stress. This is conventionally performed in upstream inflow housings. These additional inflow housings can however lead to energy losses.

In the case of a single-shell or single-housing steam turbine with intermediate superheating, greatly superheated process steam is conducted into the turbine at two locations. Here, the steam turbine outer housing in particular is subjected to high thermal loading by the occurring temperatures and pressures.

The occurring required parameters however often lie above the possible parameters of single-shell turbine housings. The applicant's patent application DE 10 2017 211 295, which was not published before the priority date of the present patent application, therefore proposes a steam turbine and a method for operating such a steam turbine, which substantially overcome the disadvantages.

The steam turbine has a steam turbine outer housing. Furthermore, the steam turbine has a high-pressure inner housing with a first process steam inlet section and with a first process steam outlet section for conducting process steam through the high-pressure inner housing from the first process steam inlet section to the first process steam outlet section in a first process steam expansion device. Furthermore, the steam turbine has a low-pressure inner housing with a second process steam inlet section and with a second process steam outlet section for conducting process steam through the low-pressure inner housing from the second process steam inlet section to the second process steam outlet section in a second process steam expansion direction. Furthermore, the steam turbine has an intermediate superheater which is arranged downstream of the high-pressure inner housing and downstream of the low-pressure inner housing, wherein the high-pressure inner housing and the low-pressure inner housing are arranged within the steam turbine outer housing.

The high-pressure inner housing and the low-pressure inner housing are arranged such that the first steam inlet section of the high-pressure inner housing faces toward the second steam inlet section of the low-pressure inner housing. The statement that the first steam inlet section of the high-pressure inner housing faces toward the second steam inlet section of the low-pressure inner housing is to be understood to mean that the first steam inlet section of the high-pressure inner housing points or is oriented in the opposite direction, or substantially in the opposite direction, to the second steam inlet section of the low-pressure inner housing. Correspondingly, the first process steam expansion direction runs counter or substantially counter to the second process steam expansion direction.

The high-pressure inner housing and the low-pressure inner housing are thus arranged such that a process steam flow direction through the high-pressure inner housing runs oppositely, in particular oppositely by 180°, to a process steam flow direction through the low-pressure inner housing.

Using such a steam turbine, superheated process steam in the form of fresh steam can be fed into the high-pressure inner housing, which is turned counter to a steam direction, and expanded to the pressure and temperature level of so-called cold intermediate superheating. After the process steam has emerged from the high-pressure inner housing, the process steam can be fed to the intermediate superheater. Process steam from the intermediate superheater, which has undergone intermediate superheating, can then flow into the low-pressure inner housing, which faces in a main flow direction, and can expand there to condensation pressure in the steam turbine.

The low-pressure inner housing is to be understood to mean an inner housing in which, at least on average, a lower pressure prevails or is generated than in the high-pressure inner housing. That is to say, the low-pressure inner housing can also be understood in particular to mean a medium-pressure inner housing.

The process steam is to be understood to mean steam, in particular water vapor, which flows through components of the steam turbine during the operation of the steam turbine.

By means of the arrangement of the high-pressure inner housing and of the low-pressure inner housing, excitatory forces in the low-pressure inner housing can be minimized, because only the pressure difference from the intermediate superheating acts. Process steam can, for further expansion, be conducted directly into the next component, for example a further low-pressure inner housing, and does not first need to be diverted.

An expansion direction is to be understood to mean a direction in which the process steam primarily moves or is conducted. That is to say, if the process steam moves for example from left to right in a steam turbine section, this is to be understood, in simplified terms, to mean a linear expansion direction to the right. Furthermore, in the present case, an expansion direction is to be understood to mean a pressure direction from a high-pressure region into a low-pressure region or into a pressure region with a lower pressure than in the high-pressure region. Correspondingly, an upstream steam turbine section is to be understood to mean a section which is arranged counter to the expansion direction.

The fact that the high-pressure inner housing is initially traversed by the cold steam that is being conducted for intermediate superheating, and is flowed through subsequently by the hot steam passing from the intermediate superheating process, still constitutes a major challenge. Furthermore, there is the possibility, which must be prevented, of the cold steam conducted for intermediate superheating being drawn into the low-pressure inner housing owing to the pressure loss in the intermediate superheating process. The present invention seeks to eliminate these disadvantages of the prior art.

SUMMARY OF INVENTION

With regard to the steam turbine according to the invention, the object is achieved by means of the features of the independent patent claim. With regard to the method for operating such a steam turbine, the object is achieved by means of the features of the independent patent method claim.

The subclaims relate to further advantages and refinements of the invention, which may be used individually or in combination with one another.

According to a first aspect of the invention, a steam turbine is provided. The steam machine has a steam turbine outer housing. Furthermore, the steam turbine has a high-pressure inner housing with a first process steam inlet section and with a first process steam outlet section for conducting process steam through the high-pressure inner housing from the first process steam inlet section to the first process steam outlet section in a first process expansion device. Furthermore, the steam turbine has a low-pressure inner housing with a second process steam inlet section and with a second process steam outlet section for conducting process steam through the low-pressure inner housing from the second process steam inlet section to the second process steam outlet section in a second process steam expansion device. Furthermore, the steam turbine has an intermediate superheater for intermediate superheating of process steam which can be extracted downstream of the high-pressure inner housing and upstream of the low-pressure inner housing. Here, the high-pressure inner housing and the low-pressure inner housing are arranged within the steam turbine outer housing, and the high-pressure inner housing and the low-pressure inner housing are arranged such that the first steam inlet section of the high-pressure inner housing faces toward the second steam inlet section of the low-pressure inner housing, and wherein, furthermore, downstream of the high-pressure inner housing, there is formed a process steam diverting section for diverting process steam from the first steam outlet section in a direction counter to the first steam expansion device into a gap which extends between an inner wall of the steam turbine outer housing and an outer wall of the high-pressure inner housing and at least in certain sections between the inner wall of the steam turbine outer housing and an outer wall of the low-pressure inner housing. Also, here, at an upstream end section of the high-pressure inner housing, at which the first process steam inlet section is formed, there is arranged a high-pressure sealing shell for at least partially sealing off the upstream end section of the high-pressure inner housing, and, at an upstream end section of the low-pressure inner housing, at which the second process steam end section is formed, there is arranged a low-pressure sealing shell for at least partially sealing off the upstream end section of the low-pressure inner housing, and wherein the high-pressure sealing shell and the low-pressure sealing shell are arranged adjacent to one another. Here, according to the invention, the high-pressure inner housing is designed such that process steam can be extracted from the high-pressure inner housing and conducted into a region between the high-pressure sealing shell and the low-pressure sealing shell. The process steam that can be extracted from the high-pressure inner housing is directly throttled to intermediate superheating parameters without performing work. In this way, the steam is considerably warmer than the process steam that has been expanded within the first steam expansion device. The extracted process steam can be utilized for being conducted into a region of the high-pressure sealing shell and of the low-pressure sealing shell in order, there, to locally warm the region and in particular the second inner housing. In this way, so-called cold spots at the rotor and in the region of the second steam inlet section of the low-pressure inner housing cannot occur. This yields a temperature distribution which is positive both in terms of rotor mechanics and in terms of rotor dynamics. Owing to the reduced thermally driven deformation at the low-pressure inner housing, the degrees of play between the rotor of the steam turbine and the inner housing can be set to be smaller. This increases the efficiency of the steam turbine. By means of the imparted temperature field, it is furthermore possible for higher absolute temperature differences to be realized in the intermediate superheating process, which in turn increases the process efficiency of the overall system. The range of application of the single case reheat turbine, that is to say of the turbine with a single outer housing, is hereby expanded. This has considerable cost advantages in relation to the alternative multi-case turbine, in which multiple outer housings are used. More cost-effective turbines can thus be offered in a broader performance range.

One refinement of the invention provides that the high-pressure sealing shell is designed such that a predefinable leakage mass flow can be conducted via the high-pressure sealing shell into a region between the high-pressure sealing shell and the low-pressure sealing shell. By virtue of the fact that the high-pressure sealing shell is designed such that a sufficiently great steam mass flow (leakage flow) can be conducted through the high-pressure sealing shell into the region between the high-pressure sealing shell and the low-pressure sealing shell, the intermediate space between the two sealing shells can be correspondingly warmed, such that the characteristics in terms of rotor mechanics and rotor dynamics with regard to the temperature are positively influenced, such that no cold spots arise at the rotor, and the region of the second process steam inlet section is correspondingly pre-warmed. It is thus possible to omit the additional formation of lines and passages within the first expansion device, whereby the outlay in terms of construction is considerably reduced. In principle, the inherently present leakage flow of the high-pressure sealing shell is used for warming purposes, wherein the high-pressure sealing shell must be configured such that the leakage mass flow is greater than would technically be required. The leakage mass flow can in this case be determined or set simply by means of a corresponding enlargement of the gap between the sealing shells and the rotor.

A further refinement of the invention provides that the high-pressure sealing shell and the low-pressure sealing shell are designed and coordinated with one another such that the leakage mass flow via the high-pressure sealing shell is greater than the leakage mass flow via the low-pressure sealing shell. It is advantageous here if the leakage mass flow via the high-pressure sealing shell is at least 30%, advantageously at least 50%, greater than the leakage mass flow via the low-pressure sealing shell. The difference in the mass flows gives rise to a sealing mass flow which prevents an ingress of the cold intermediate superheating steam into the low-pressure sealing shell and thus into the second expansion device. The hot leakage mass flow from the first expansion device serves here for preheating of the rotor between the first sealing shell and the second sealing shell and for preheating in particular of the second process steam inlet section at the second expansion device.

A further refinement of the invention provides that, at a downstream end section of the low-pressure inner housing, there is formed a sealing web for sealing off a steam turbine region between the downstream end section of the low-pressure inner housing and the steam turbine outer housing. In the case of the present steam turbine, the low-pressure inner housing is flowed around by process steam during operation. Meanwhile, the high-pressure inner housing is separated from the low-pressure inner housing by the sealing web, which is advantageously formed as an integrated sealing web on the downstream end section of the low-pressure inner housing. Using the sealing web, an inner sealing shell at the downstream end section of the low-pressure inner housing can be omitted. The sealing web has a considerably less complex construction than a sealing shell. At this juncture, it is pointed out that, in the present case, a sealing shell is to be understood to mean a sealing shell such as is conventional from the prior art, which will therefore not be described in detail in the present case.

A further refinement of the invention provides that the intermediate superheater is arranged outside the steam turbine outer housing. This is advantageous in particular with regard to assembly, disassembly, maintenance and repair.

According to a further aspect of the present invention, a method for operating a steam turbine as presented in detail above is provided. Thus, a method according to the invention yields the same advantages as have been described in detail with regard to the steam turbine according to the invention. The method has the following steps of: —conducting process steam from a process steam source through the first process steam inlet section into the high-pressure inner housing, —conducting the process steam from the first process steam inlet section to the first process steam outlet section, and—conducting the process steam through the first process steam outlet section from the high-pressure inner housing via the process steam diverting section and the gap to the intermediate superheater, and—extracting a proportion of the process steam from the high-pressure inner housing, expanding said proportion of the process steam to intermediate superheating parameters, and introducing the extracted process steam in the region between the high-pressure sealing shell and the low-pressure sealing shell.

The method yields a temperature distribution which is positive in terms of rotor mechanics and in terms of rotor dynamics. By means of the imparted temperature field, it is possible for higher absolute temperature differences to be realized in the intermediate superheating process, and thus for the efficiency of the overall system to be increased.

One refinement of the method provides that the extracted process steam (leakage steam) is conducted via the high-pressure sealing shell into the region between the high-pressure sealing shell and the low-pressure sealing shell. In this way, the method according to the invention can be implemented with low outlay in terms of construction and thus cost-effectively. Conversion of existing steam turbines to the described process can be realized using simple means.

BRIEF DESCRIPTION OF THE DRAWINGS

Further measures that improve the invention will emerge from the following descriptions of various exemplary embodiments of the invention, which are schematically illustrated in the figures. All features and/or advantages that emerge from the claims, from the description or from the drawing, including design details and spatial arrangements, may be essential to the invention both individually and in various combinations. In the drawing:

DETAILED DESCRIPTION OF INVENTION

Figure 1:
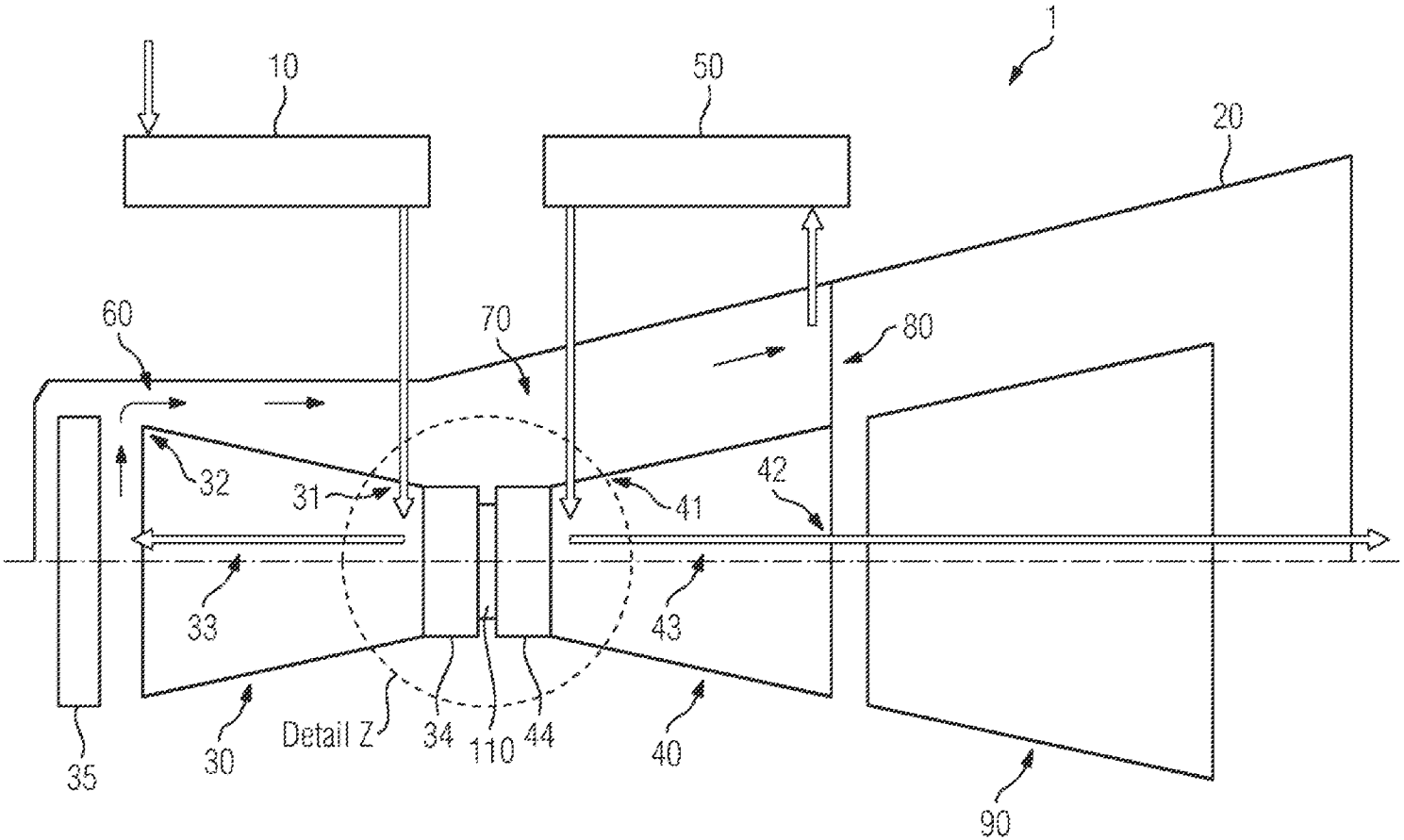
FIG. 1 shows the basic construction of a steam turbine according to the invention.

FIG. 1 shows the basic construction of a steam turbine 1 according to the invention. The steam turbine 1 has a steam turbine outer housing 20, in which a high-pressure inner housing 30, a low-pressure inner housing 40 in the form of a medium-pressure inner housing, and a further low-pressure inner housing 90 are situated. Arranged upstream of the high-pressure inner housing 30 is a fresh steam or process steam source 10 for the supply of process steam to the high-pressure inner housing 30. The high-pressure inner housing 30 has a first process steam inlet section 31 and a first process steam outlet section 32 for conducting process steam through the high-pressure inner housing 30 from the first process steam inlet section 31 to the first process steam outlet section 32 in a first process steam expansion device 33. The low-pressure inner housing 40 has a second process steam inlet section 41 and a second process steam outlet section 42 for conducting process steam through the low-pressure inner housing 40 from the second process steam inlet section 41 to the second process steam outlet section 42 in a second process steam expansion device 43. The steam turbine 1 furthermore has an intermediate superheater 50 which is arranged downstream of the high-pressure inner housing 30 and upstream of the low-pressure inner housing 40. The arrangement relates here not to a spatial arrangement but to an arrangement in relation to a flow.

As illustrated in FIG. 1, the high-pressure inner housing 30 and the low-pressure inner housing 40 are arranged such that the first steam inlet section 31 of the high-pressure inner housing 30 faces toward the second steam inlet section 41 of the low-pressure inner housing 40.

Downstream of the high-pressure inner housing 30, the steam turbine 1 has a process steam diverting section 60 for diverting process steam from the first steam outlet section 32 in a direction counter to the first steam expansion device 33 into a gap 70 of the steam turbine 1. The gap 70 extends between the steam turbine outer housing 20 and the high-pressure inner housing 30 and at least in certain sections between the steam turbine housing 20 and the low-pressure inner housing 40. At a downstream end section of the low-pressure inner housing 40, there is formed a sealing web 80 for sealing off a steam turbine region between the downstream end section of the low-pressure inner housing 40 and the steam turbine outer housing 20. The intermediate superheater 50 is arranged outside the steam turbine outer housing 20. The high-pressure inner housing 30 and the low-pressure inner housing 40 are provided as separate components in a common steam turbine outer housing 20.

At the upstream end section of the high-pressure inner housing 30, at which the first process steam inlet section 31 is formed, there is arranged a high-pressure sealing shell 34 for partially sealing off the downstream end section of the high-pressure inner housing 30. Furthermore, at the upstream end section of the low-pressure inner housing 40, at which the second process steam inlet section 41 is formed, there is arranged a low-pressure sealing shell 44 for partially sealing off the upstream end section of the low-pressure inner housing 40. The high-pressure sealing shell 34 and the low-pressure sealing shell 44 are arranged adjacent to one another. At a downstream end section of the high-pressure inner housing 30, at which the first process steam outlet section 32 is formed, there is arranged a further high-pressure sealing shell 35 for at least partially sealing off the downstream end section of the high-pressure inner housing 30. The high-pressure sealing shell 34 is configured and designed such that, via it, a predefinable leakage mass flow can emerge and be conducted into the region 110 between the high-pressure sealing shell 34 and the low-pressure sealing shell 44. In the case of a predefined steam pressure and steam temperature, the sealing shell and/or the sealing gap can be configured such that a predefinable leakage mass flow passes through the sealing shell. The high-pressure sealing shell 34 and the low-pressure sealing shell 44 are coordinated with one another such that the leakage mass flow via the high-pressure sealing shell 34 is greater than the leakage mass flow via the low-pressure sealing shell 44. Preferably, the leakage mass flow via the high-pressure sealing shell 34 is at least 30%, advantageously at least 50%, greater than the leakage mass flow via the low-pressure sealing shell 44.

Figure 2:
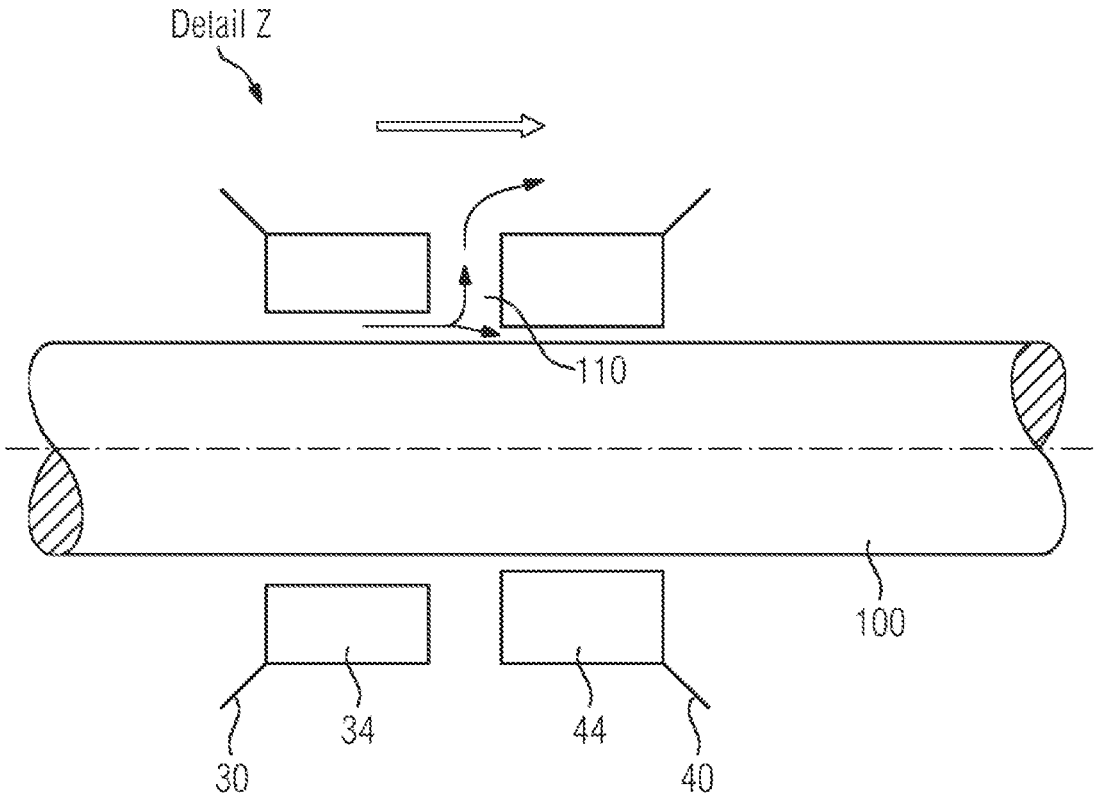
FIG. 2 shows the detail view Z, in which the method according to the invention is discussed in more detail.

FIG. 2 shows a detail view Z from FIG. 1. A method according to the invention for operating a steam turbine according to the invention will be discussed below on the basis of FIG. 2 and with reference to FIG. 1 and the descriptions given in relation thereto.

In order to seal off the gap between the shaft 100 and the upstream end section of the high-pressure inner housing 30, a high-pressure sealing shell 34 is arranged at the end section of the high-pressure inner housing 30. A low-pressure sealing shell 44 is arranged for sealing off the gap between the upstream end section of the low-pressure inner housing 40 and the shaft 100. The high-pressure sealing shell 34 and the low-pressure sealing shell 44 are arranged adjacent to one another. During the operation of the steam turbine, it is initially the case that process steam from the process steam source 10 is conducted through the first process steam inlet section 31 into the high-pressure inner housing 30. The process steam is subsequently conducted from the first process steam inlet section 31 to the first process steam outlet section 32, and is thereafter conducted through the first process steam outlet section 32 from the high-pressure inner housing 30 via the process steam diverting section 60 into the gap 70 to the intermediate superheater 50. Here, the process steam is conducted through the gap 70 in order to cool the steam turbine outer housing 20 or the steam turbine 1 along the high-pressure inner housing 30 and along the low-pressure inner housing 40. After the process steam has been heated in the intermediate superheater 50 at constant pressure to a predefined temperature, the heated or superheated process steam is conducted from the intermediate superheater 50 through the second process steam inlet section 41 into the low-pressure or medium-pressure inner housing. From there, the process steam is conducted, in an unchanged expansion direction, into the further low-pressure inner housing 90. There, the process steam can expand further and ultimately condense. In order to prevent the cooled steam that is supplied to the intermediate superheating 50 from being drawn into the gap between the high-pressure sealing shell 34 and the low-pressure sealing shell 44 and into the low-pressure inner housing 40 owing to the pressure loss in the intermediate superheating process, steam is extracted from the first high-pressure inner housing 30 and is directly throttled to intermediate superheating parameters without performing work, and said steam is conducted directly into the gap between the high-pressure sealing shell 34 and the low-pressure sealing shell 44.

In this way, the low-pressure inner housing 40 and that region 110 of the shaft 100 which is situated between the high-pressure sealing shell 34 and the low-pressure sealing shell 44 can be locally warmed. In order to extract the hot steam from the high-pressure inner housing 30, an opening in the high-pressure inner housing 30 and a corresponding pipeline, can be provided. The steam can however be extracted from the inner housing particularly easily, and without additional outlay in terms of construction, via the high-pressure sealing shell 34. For this purpose, the gap of the high-pressure sealing shell 34 must be configured correspondingly. The hot steam can then pass from the high-pressure inner housing 30 directly into the intermediate space between the first high-pressure sealing shell 34 and the second low-pressure sealing shell 44. Since the steam that flows out via the high-pressure sealing shell 34 has almost fresh steam parameters, it can be utilized for warming the region 110 between the high-pressure sealing shell 34 and the low-pressure sealing shell 44. This yields a temperature distribution which is positive in terms of rotor dynamics and in terms of rotor mechanics. The pressure is higher on the outer side of the low-pressure inner housing 40 than on the inner side, the reason for this being the pressure loss in the gap that leads to the intermediate superheating 50. The process steam that is extracted from the high-pressure inner housing 30 and conducted in the region 110 between the high-pressure sealing shell 34 and the low-pressure sealing shell 44 is thus drawn into the low-pressure inner housing 40, and serves there for warming the low-pressure inner housing 40. The high-pressure sealing shell 34 and the low-pressure sealing shell 44 are coordinated with one another such that the process steam that flows out via the high-pressure sealing shell 34 is at least 30%, advantageously at least 50%, greater than the leakage mass flow via the low-pressure sealing shell 44. The difference in the mass flows gives rise to a sealing mass flow which prevents the ingress of cold steam, which is flowing to the intermediate superheater 50, into the high-pressure sealing shell 34.

The invention claimed is:

1. A steam turbine, comprising:

a steam turbine outer housing, a high-pressure inner housing with a first process steam inlet section and with a first process steam outlet section for conducting process steam through the high-pressure inner housing from the first process steam inlet section to the first process steam outlet section in a first process steam expansion direction, a low-pressure inner housing with a second process steam inlet section and with a second process steam outlet section for conducting process steam through the low-pressure inner housing from the second process steam inlet section to the second process steam outlet section in a second process steam expansion direction, and an intermediate superheater for intermediate superheating of process steam which can be extracted downstream of the high-pressure inner housing and upstream of the low-pressure inner housing, wherein the high-pressure inner housing and the low-pressure inner housing are arranged within the steam turbine outer housing, wherein the high-pressure inner housing and the low-pressure inner housing are arranged such that the first process steam inlet section of the high-pressure inner housing faces toward the second process steam inlet section of the low-pressure inner housing, wherein downstream of the high-pressure inner housing, there is formed a process steam diverting section for diverting process steam from the first process steam outlet section in a direction counter to the first process steam expansion direction into a gap which extends between an inner wall of the steam turbine outer housing and an outer wall of the high-pressure inner housing and at least in certain sections between the inner wall of the steam turbine outer housing and an outer wall of the low-pressure inner housing, wherein the intermediate superheater is configured to extract the process steam from a location disposed downstream of the process steam diverting section, wherein at an upstream end section of the high-pressure inner housing, at which the first process steam inlet section is formed, there is arranged a high-pressure sealing shell for at least partially sealing off the upstream end section of the high-pressure inner housing, and, at an upstream end section of the low-pressure inner housing, at which the second process steam inlet section is formed, there is arranged a low-pressure sealing shell for at least partially sealing off the upstream end section of the low-pressure inner housing, and wherein the high-pressure sealing shell and the low-pressure sealing shell are arranged adjacent to one another, wherein the high-pressure inner housing is designed such that process steam can be extracted from the high-pressure inner housing and conducted into a region between the high-pressure sealing shell and the low-pressure sealing shell.

2. The steam turbine as claimed in claim 1, wherein the high-pressure sealing shell is designed such that a predefinable leakage mass flow can be conducted via the high-pressure sealing shell into ainto the region between the high-pressure sealing shell and the low-pressure sealing shell.

3. The steam turbine as claimed in claim 2, wherein the high-pressure sealing shell and the low-pressure sealing shell are designed and coordinated with one another such that the leakage mass flow via the high-pressure sealing shell is greater than a leakage mass flow via the low-pressure sealing shell.

4. The steam turbine as claimed in claim 3, wherein the leakage mass flow via the high-pressure sealing shell is at least 30% greater than the leakage mass flow via the low-pressure sealing shell.

5. The steam turbine as claimed in claim 1, wherein, at a downstream end section of the low-pressure inner housing, there is formed a sealing web for sealing off a steam turbine region between the downstream end section of the low-pressure inner housing and the steam turbine outer housing.

6. The steam turbine as claimed in claim 1, wherein the intermediate superheater is arranged outside the steam turbine outer housing.

7. A method for operating a steam turbine as claimed in claim 1, the method comprising:

conducting process steam from a process steam source through the first process steam inlet section into the high-pressure inner housing, conducting the process steam from the first process steam inlet section to the first process steam outlet section, conducting the process steam through the first process steam outlet section from the high-pressure inner housing via the process steam diverting section and the gap to the intermediate superheater, extracting a proportion of the process steam from the high-pressure inner housing, expanding said proportion of the process steam to intermediate superheating parameters, and introducing the extracted process steam into the region between the high-pressure sealing shell and the low-pressure sealing shell.

8. The method for operating a steam turbine as claimed in claim 7, wherein the extracted process steam is leakage steam which is conducted via the high-pressure sealing shell into the region between the high-pressure sealing shell and the low-pressure sealing shell.

9. The steam turbine as claimed in claim 4, wherein the leakage mass flow via the high-pressure sealing shell is at least 50% greater than the leakage mass flow via the low-pressure sealing shell.

10. A steam turbine, comprising:

a steam turbine outer housing;

a high-pressure inner housing comprising a high-pressure sealing shell at an upstream end section thereof, and a low-pressure inner housing comprising a low-pressure sealing shell at an upstream end section thereof, both disposed within the steam turbine outer housing and arranged such that a first steam inlet section of the high-pressure inner housing faces toward a second steam inlet section of the low-pressure inner housing;

a process steam diverting section configured to divert process steam exiting the high-pressure inner housing into a gap which extends between an inner wall of the steam turbine outer housing and an outer wall of the high-pressure inner housing and at least in certain sections between the inner wall of the steam turbine outer housing and an outer wall of the low-pressure inner housing; and an intermediate superheater configured to extract process steam from a location downstream of the process steam diverting section with respect to a direction of flow of the process steam that flows through the process steam diverting section, and to superheat the process steam;

wherein the high-pressure inner housing is designed such that process steam can be extracted from the high-pressure inner housing and conducted into a region between the high-pressure sealing shell and the low-pressure sealing shell.

* * * * *